US007127885B2

(12) United States Patent
Mundry et al.

(10) Patent No.: US 7,127,885 B2
(45) Date of Patent: Oct. 31, 2006

(54) ASSEMBLY FOR USE IN UNDERGROUND MINING

(75) Inventors: Sebastian M. Mundry, Lüdinghausen (DE); Jens Titschert, Lünen (DE); Werner Reinelt, Bochum (DE); Franz-Heinrich Suilmann, Werne (DE); Patrick Hantke, Aachen (DE); Torsten Boldt, Aachen (DE); Jurgen Romanski, Rosenheim (DE); Horst Wagner, Edling (DE)

(73) Assignee: DBT GmbH, Lunen (DE)

( * ) Notice: Subject to any disclaimer, the term of this patent is extended or adjusted under 35 U.S.C. 154(b) by 250 days.

(21) Appl. No.: 10/785,640

(22) Filed: Feb. 24, 2004

(65) Prior Publication Data

US 2004/0221713 A1 Nov. 11, 2004

(30) Foreign Application Priority Data

Mar. 11, 2003 (DE) ..... 103 10 893

(51) Int. Cl.
*F16D 31/00* (2006.01)

(52) U.S. Cl. ..... 60/368; 700/282

(58) Field of Classification Search ..... 60/368; 700/282

See application file for complete search history.

(56) References Cited

U.S. PATENT DOCUMENTS 4,099,782 A 7/1978 Weirich et al.
4,439,063 A 3/1984 Heitkamp
4,811,561 A * 3/1989 Edwards et al. ..... 60/368
5,519,636 A * 5/1996 Stoll et al. ..... 700/282
6,119,721 A * 9/2000 Watanabe et al. ..... 700/282
6,382,257 B1 * 5/2002 Mead et al. ..... 700/282
6,481,802 B1 11/2002 Kussel

FOREIGN PATENT DOCUMENTS

DE 10207698 10/2002

* cited by examiner

*Primary Examiner*—F. Daniel Lopez
(74) *Attorney, Agent, or Firm*—Fay, Sharpe, Fagan, Minnich & McKee, LLP

(57) ABSTRACT

An electro-hydraulic assembly for use in underground mining is disclosed. The assembly includes a hydraulic component, such as a valve block for an underground self-advancing roof support, as well as actuators and/or sensors which have a housing and can be connected or are connected via a data-transmission system to a control unit. A function (e.g. withdrawing the support, setting, advancing, or the like) can be activated at the hydraulic component by each actuator, and/or a hydraulic state associated with a measuring point of the hydraulic component or another measured variable associated with the self-advancing roof support can be measured by each sensor. A reader unit is associated with each actuator and/or sensor in its respective housing, and an information element or transponder is associated with the hydraulic component for each function, each control valve, or each measuring point. The information in the information element or transponder is readable by the reader unit and transmittable to the control unit. All the control valves and sensors are coded for the control unit and the control unit can associate each actuator with its corresponding control valve. In this way, it can be known which actuator is associated with which function of the hydraulic component and connection faults can be avoided.

15 Claims, 2 Drawing Sheets

ASSEMBLY FOR USE IN UNDERGROUND MINING

FIELD OF THE INVENTION

The invention relates to an assembly comprising an electro-hydraulic component for use in underground mining, especially for use in an underground self-advancing roof support system. The assembly may also include actuators and/or sensors, which can be, or are, in communication with a control unit via a data-transmission system. The actuators may be activated at the hydraulic component to provide one or more functions. The sensors may be utilized to measure one or more variables, such as hydraulic states, related to the self-advancing roof support system.

BACKGROUND OF THE INVENTION

Various hydraulic assemblies are used in underground mining, such as electro-hydraulic valve blocks or strips for controlling the hydraulic functions of shields used in underground longwall mining. In this case, each valve strip is provided with a plurality of hydraulic control valves and each control valve can be controlled by use of an actuator mounted on the valve strip specifically for this purpose. In underground mining, it is typical to use actuators which are identical in structure and appearance on the valve strips of all shields so that, in the case of a fault of one of the actuators for instance, that faulty actuator can be replaced by any other actuator. When replacing one actuator or when one or more control valves are replaced, the miner must ensure that the correct actuator is always assigned to each control valve. The valve strips of underground shields therefore present a potential risk of assembly and connection faults that are attributable to operator error. The same also applies to the sensors associated with underground shields. Such sensors typically measure for instance, the position of individual canopy bars or lifting props, or measure the hydraulic pressure in the cylinders or props forming the hydraulic components of the shield.

It is an objective of the invention to provide an assembly of hydraulic components which may include actuators and/or sensors for underground mining, in which the aforementioned risks associated with personnel-related connection faults is reduced or eliminated.

SUMMARY OF THE INVENTION

In a first aspect, the present invention provides an assembly adapted for use in mining operations and particularly in an underground self-advancing roof support system. The assembly comprises a hydraulic component which may, for example, be in the form of a hydraulic valve strip or valve block. The assembly also comprises a collection of actuators and/or sensors. Each actuator and/or sensor preferably has a housing and is adapted for communication with a control unit via a data transmission system. Each actuator is configured to actuate a respective function of the hydraulic component. If one or more sensors are utilized, each sensor is configured to measure the hydraulic state of a respective variable of the hydraulic component or another measurable variable associated with the self-advancing roof support system. The assembly also comprises a collection of reader units. Each of the reader units is associated with a corresponding actuator or sensor. And, each reader unit is disposed proximate a corresponding actuator or sensor. The assembly also comprises a collection of information elements. Each information element is associated with a particular function or measuring point of the hydraulic component. Information in each information element is readable by a corresponding reader unit and transmittable to the control unit.

In another aspect, the present invention provides an electro-hydraulic assembly particularly adapted for use with an underground self-advancing roof support as utilized in mining operations. The assembly comprises a valve body defining a collection of recesses adapted for receiving and retaining hydraulic valves. The assembly also comprises a collection of hydraulic valves, each of the valves being disposed in a respective recess defined in the valve body. The assembly further comprises a collection of actuators, wherein each of the actuators is in operable engagement with a respective valve of the collection of valves. And, the assembly comprises a collection of information elements. Each of the information elements is disposed proximate to a respective valve and is adapted to identify that valve. The assembly further comprises a collection of reader units. Each unit is in communication with a respective information element and adapted to transmit information concerning the identity of the respective valve by the information element.

In yet another aspect, the present invention provides an electro-hydraulic assembly for use with an underground self-advancing support for mining. The assembly comprises a hydraulic body that defines a first set of recesses and a second set of recesses. The assembly also comprises at least one hydraulic control valve disposed in one of the first set of recesses of the hydraulic body. The assembly also includes at least one actuator configured to actuate the at least one hydraulic control valve. The assembly further comprises at least one information element disposed in one of the second set of recesses. The information element is configured to provide information as to the identity of the valve disposed in the hydraulic body. And, the assembly comprises at least one reader unit in communication with the information element and adapted to transmit information as to the identity of the valve disposed in the hydraulic body.

BRIEF DESCRIPTION OF THE DRAWINGS

Further advantages and developments of the aspects of the invention will become apparent from the following description of preferred embodiments shown schematically in the drawings, which are as follows.

DETAILED DESCRIPTION OF THE PREFERRED EMBODIMENTS

Figure 1:
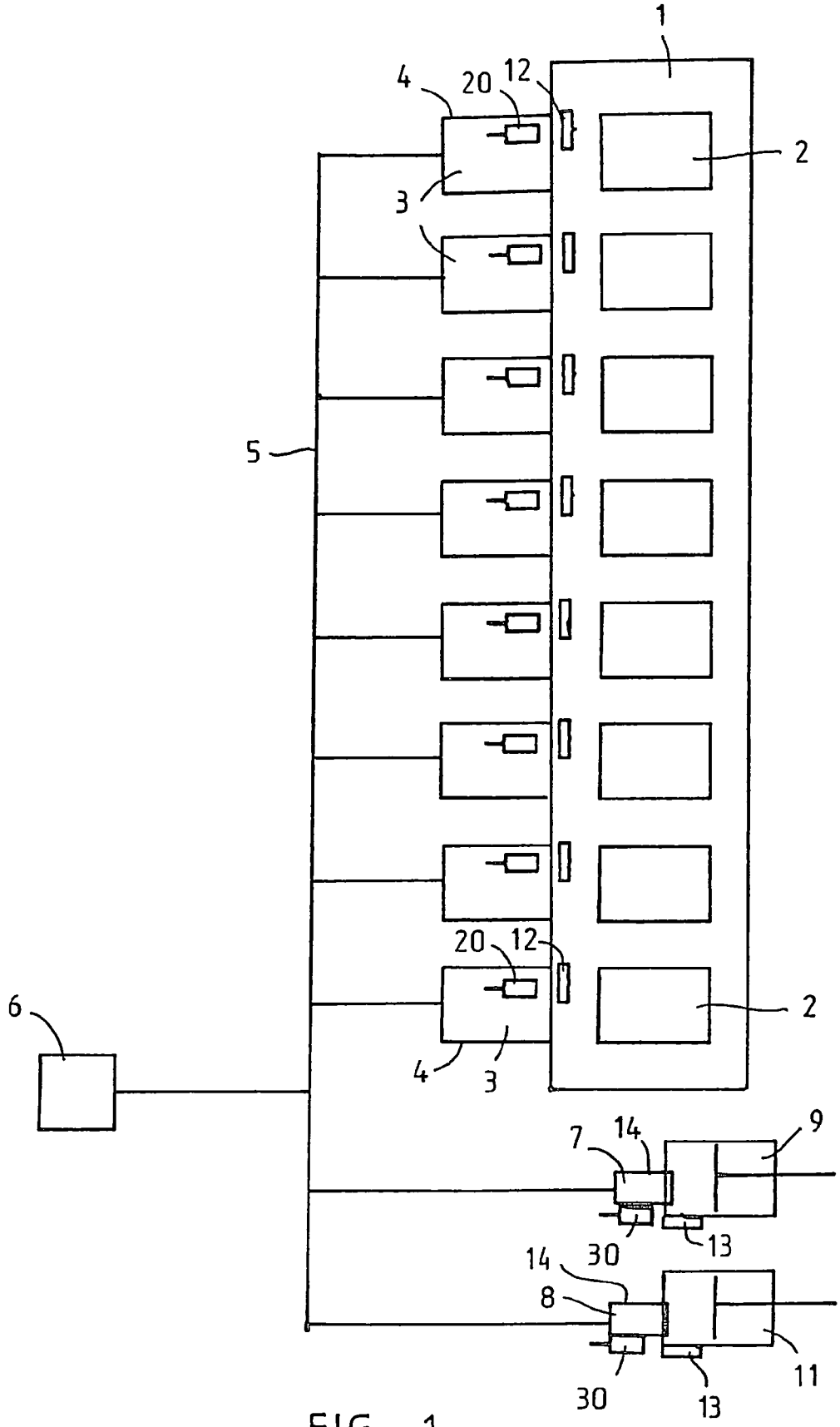
FIG. 1 schematically represents a preferred embodiment system according to the invention including an electro-hydraulic valve block, a collection of valves, actuators, a control unit, and a data-transmission system.

The present invention provides an electro-hydraulic assembly including a hydraulic valve assembly or block which utilizes various actuators and/or sensors, a reader unit associated with each actuator and/or sensor in the assembly, and corresponding information elements associated with hydraulic component(s) of the assembly. The information provided by the information element is read or sensed by the reader unit and transmitted to a control unit. The present invention ensures that the control unit is updated at all times as to which actuator is performing a specific function concerning a hydraulic component of the hydraulic assembly. When, for example, the hydraulic component includes a plurality of control valves, each of which corresponds to a specific function of the electro-hydraulically controlled shield, a mix-up between two actuators will be detected by the control unit and, in order to obtain a specific function, the control unit will activate the correct actuator to achieve the desired function despite the mix-up between actuators. Therefore, the invention can provide for an automatic coding and identification of all the control valves, and/or the sensors, associated with a roof support shield. That is, the control unit can associate each actuator with a corresponding control valve, or associate each sensor with the variable it is configured to measure. The assembly or system according to the present invention can utilize actuators, or sensors or both actuators and sensors.

In a preferred embodiment, the reader units comprise a transmitting module and a receiving module and/or are adapted for transmitting and receiving. The information element is preferably a transmitter or transponder, and preferably a microchip or a transponder chip with integrated EEPROM. In a particularly preferred embodiment, the information element, especially if it is a transmitter or transponder, is read inductively and without contact and the reader units are designed for transmitting and/or receiving electromagnetic waves. Furthermore, the transmitter or transponder or the respective microchip or transponder chip is preferably provided with an integrated receiving coil, and the transmitting module and/or the receiving module preferably takes the form of, or comprises, a coil. The reader unit is preferably coupled with an electronic circuit, which may include a microcontroller. It is particularly advantageous if the electronic circuit includes control electronics and evaluating electronics for the reader unit. Additionally, it is particularly advantageous if the actuator can also be controlled by the microcontroller based upon information obtained from the reader units and/or information elements.

The reader unit can be mounted, screwed, glued or otherwise secured to the actuator, valve block, housing, or other component. In a preferred embodiment, the reader unit is sealed in casting compound and/or inserted in a receiving recess in or on the actuator. The information element can be mounted, screwed, glued or otherwise attached at the measuring point or on the component for each controllable function. In a preferred embodiment, the information element is inserted into a receiving recess in the hydraulic component of the hydraulic assembly and sealed with casting compound. As previously noted, the hydraulic assembly preferably includes a valve strip or a valve block having a plurality of holes or recesses for receiving hydraulic switching valves, and information elements, in which data is stored, associated with each receiving hole. The data associated with a particular information element is distinguishable from information associated with other information elements. The data-transmission system preferably involves a BUS, which may be a CAN BUS.

Represented schematically in the block wiring diagram shown in FIG. 1 is an electro-hydraulic control system associated with a support shield—not shown in further detail—for a typical underground self-advancing roof support system. The electro-hydraulic control system comprises a hydraulic valve block 1, which in this case is fitted with a total of eight control valves 2, each of which is seated in its appropriate receiving hole and can activate a different function associated with the roof support shield, such as for example extending a canopy bar of the shield, setting or withdrawing the shield, advancing the conveyor or shield, or the like. The individual control valves 2 are preferably identical with one another and arranged in groups, in this case side by side, in the valve block 1. The hydraulic side is not represented. An actuator 3 is associated with each control valve 2, the actuator being disposed for example on the outside of the valve block 1 and being screwed together with the block. Each actuator 3 includes a housing 4, in which an electromagnet, which is not represented, or a piezo element including the appropriate components for triggering a switching movement of the control valve are disposed. The individual actuators 3 for each control valve 2 are preferably identical with one another and all the actuators 3 are connected via the BUS 5 to an electronic control unit 6 as well as to a power supply, preferably an intrinsically safe direct-current source, which is not shown in detail. The control unit 6 is preferably configured to provide an output signal in response to one or more input signals. Furthermore, another two sensors 7, 8 are connected to the BUS 5, which can for example be a CAN BUS, the measuring signals of the sensors 7, 8 being transmittable via the BUS 5 to the control unit 6. The hydraulic states associated with the two schematically represented hydraulic lifting props 9, 11 can be measured by means of the sensors 7, 8. The configuration of the control system for an electro-hydraulic roof-support is generally known in principle from the prior art.

Now according to the invention, an information element 12 is associated with each control valve 2 in the valve block 1, the individual information elements 12 being different from one another in regards to the stored data. Stored on each information element 12 is an item of information which enables clear identification of the information element 12 by the control unit 6. In this respect, information is registered in the data memory of the control unit 6 as to which information element 12 corresponds to which position on the valve block 1 and consequently, which function in respect of the shield is controlled when the associated control valve 2 is activated. Preferably, the data on the information elements 12 can be read inductively and without contact. A reader unit 20 is provided in the housing 4 of each actuator 3 for this purpose. The reader unit 20 includes a coil for generating a magnetic field and for the inductive reading of the data on the information element 12. By reading the noted information and transmission of this information via the BUS 5 to the control unit 6, it is made known to the latter which actuator 3 is presently associated with which control valve 2 and whether the actuator 3 is available.

Also associated with each of the two measuring points associated with the sensors 7, 8 on the cylinders 9, 11 is an information element 13 which can be read by means of an associated reader unit 30 fixed in each case to the housing 14 of the sensors 7, 8. As a result, the measuring point from which the measuring signals, transmitted from the sensors 7 and 8 respectively, originate is also made known to the control unit 6.

Figure 2:
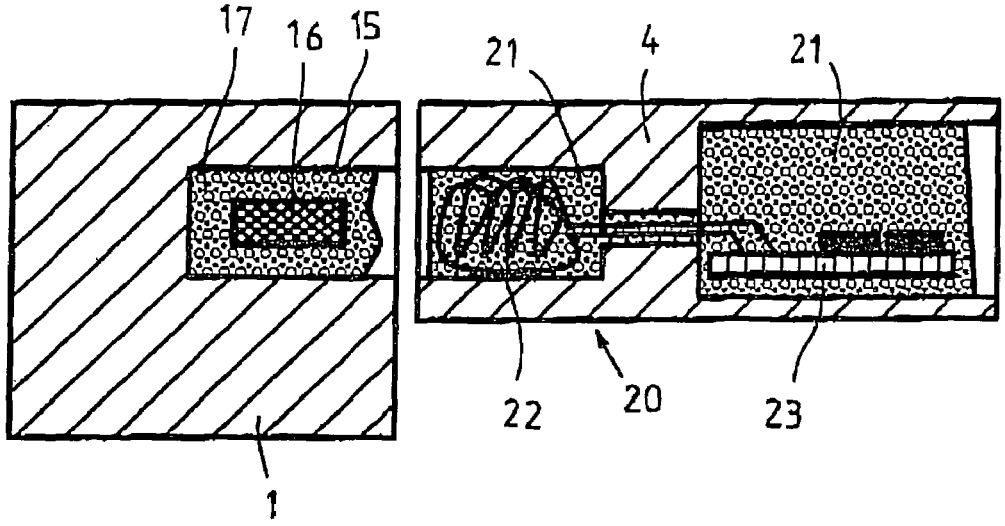
FIG. 2 schematically represents a preferred embodiment sealed transponder and sealed reader unit.

FIG. 2 shows schematically a portion of a valve block 1 with a receiving recess 15, in which a transponder 16 is inserted as an information element and is sealed in casting compound 17. As a result, the transponder 16 is protected from the adverse effects of dust and dampness in underground mining operations. The transponder is provided with a read-only memory (EEPROM). Disposed in the housing 4 of an actuator 3 (FIG. 1), as schematically represented, is a reader unit, marked as a whole with the reference number 20, which is also sealed in casting compound 21. The reader unit 20 includes a coil 22, which is disposed in the housing 4 in such a way that, in the assembled state of the actuator 3 on the valve block 1, as far as possible it lies directly opposite the recess 15 for receiving the transponder 16. The coil 22 is connected to an electronic circuit 23, which can include control electronics and evaluating electronics.

Figure 3:
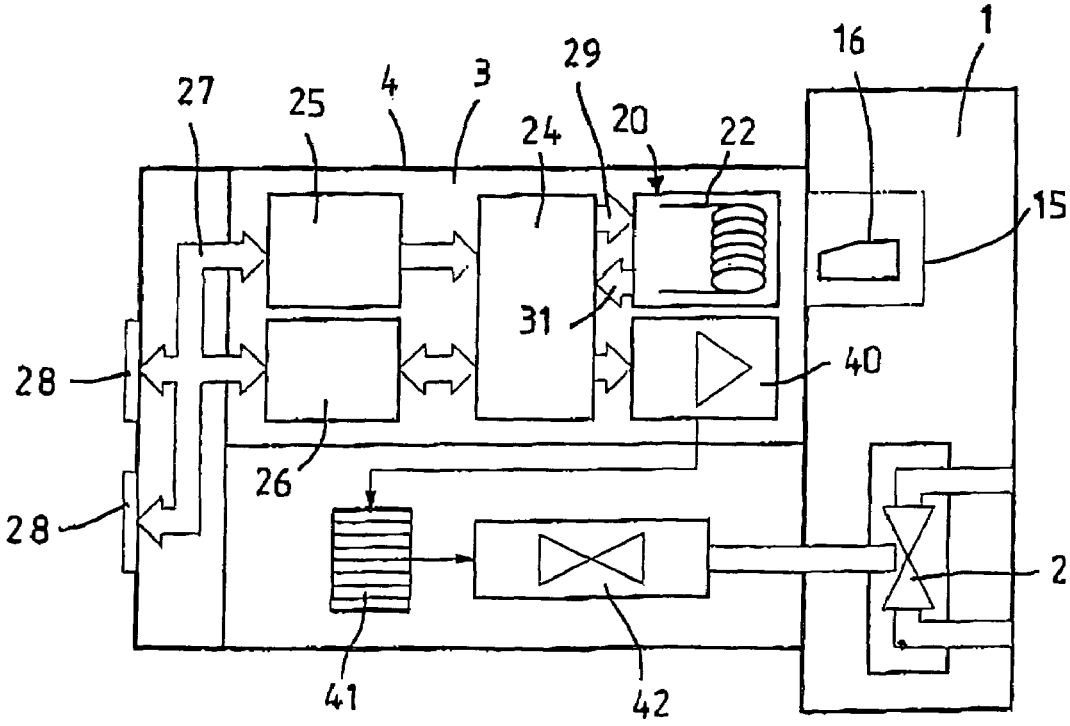
FIG. 3 schematically represents the components of a preferred embodiment actuator module having a piezo element and reader unit as well as a transponder on the valve block.

With reference to FIG. 3, by way of example the invention is again discussed for a piezoelectric actuator. The components which are the same as those in the previous examples are provided with the same reference numbers. Disposed in the valve block 1 is a hydraulic control valve 2 which is controlled by the actuator 3. An inductively readable transponder 16, sealed in casting compound, is disposed in a receiving recess 15 in the valve block 1. Disposed in the housing 4 of the actuator 3 in a position lying opposite the transponder 16 is the coil 22 of a reader unit 20, by which the data on the transponder 16 can be inductively read. Also disposed in the actuator housing 4 are a microcontroller 24, a power pack 25 and a digital interface 26, e.g. an RS 485. As indicated by the arrow 27, the power pack 25 in the housing 4 is supplied with electric energy via the BUS—not shown here—which is connected to the plug-in module 28. The control signals of the control unit, which are not shown here, can be transmitted to the microcontroller 24 in the housing 4 and the data of the microcontroller 24 can be transmitted back to the control unit via the digital interface 26 and the BUS. The microcontroller 24 switches the reader unit 20 for reading the data on the transponder 16, and the electromagnetically read-out data are transmitted to the microcontroller 24 as indicated by the arrow 31. The microcontroller 24 simultaneously controls a piezo amplifier 40, by way of which a piezo-ceramic element 41 can be activated for switching the control valve 2. As schematically indicated, a path conversion 42 is provided between the piezo-ceramic element 41 and the control valve 2 to achieve adequate travel with the piezo-ceramic element 41.

Numerous modifications will be apparent to a person skilled in the art and fall within the protective scope of the claims. A plurality of actuators with one or more associated reader units can also be disposed in one or more housings. Distances or positions can also be measured by means of the sensors. The transponders can be read at intervals using a manual control command or the like after each restarting of the system and after each replacement of an actuator.

We claim:

1. An assembly adapted for use in mining operations and particularly an underground self-advancing roof support system, said assembly comprising:

a hydraulic component;

a plurality of actuators and/or sensors, each having a housing and adapted for communication with a control unit via a data transmission system, each actuator configured to actuate a respective function of the hydraulic component, and/or each sensor configured to measure the hydraulic state of a respective variable of the hydraulic component or another measurable variable associated with said self-advancing roof support system;

a plurality of reader units, each said unit associated with a corresponding actuator or sensor, each said reader unit disposed proximate said corresponding actuator or sensor, each said reader unit comprises a transmitting module and a receiving module and said transmitting module and/or said receiving module comprises a coil; and a plurality of information elements, each information element being associated with a particular function or measuring point of the hydraulic component, information in each information element being readable by a corresponding reader unit and transmittable to the control unit.

2. An assembly according to claim 1 wherein each said information element is a transmitter or transponder.

3. An assembly according to claim 1, wherein said plurality of reader units are adapted for transmitting and/or receiving electromagnetic waves.

4. An assembly adapted for use in mining operations and particularly an underground self-advancing roof support system, said assembly comprising:

a hydraulic component;

a plurality of actuators and/or sensors, each having a housing and adapted for communication with a control unit via a data transmission system, each actuator configured to actuate a respective function of the hydraulic component, and/or each sensor configured to measure the hydraulic state of a respective variable of the hydraulic component or another measurable variable associated with said self-advancing roof support system;

a plurality of reader units, each said unit associated with a corresponding actuator or sensor, each said reader unit disposed proximate said corresponding actuator or sensor; and a plurality of information elements, each information element being associated with a particular function or measuring point of the hydraulic component, information in each information element being readable by a corresponding reader unit and transmittable to the control unit each said information element is inductively readable and/or is provided with an integrated receiving coil.

5. An assembly according to claim 4, wherein each said reader unit is in communication with an electronic circuit, said circuit including a microcontroller and/or evaluating electronics and control electronics.

6. An assembly according to claim 4, wherein each said reader unit is sealed in casting compound and secured to said corresponding actuator.

7. An assembly according to claim 4, wherein each said information element is secured within a receiving recess defined in said hydraulic component and sealed in casting compound.

8. An assembly according to claim 4, wherein said hydraulic component is a valve block defining a plurality of receiving holes for hydraulic switching valves, and each information element of said plurality of information elements is associated with a respective receiving hole or switching valve.

9. An assembly according to claim 4 wherein said control unit and/or said plurality of actuators have a digital interface.

10. The assembly of claim 4 further comprising:

said control unit adapted to receive one or more input signals and provide an output signal in response thereto; and said data transmission system providing communication between said plurality of reader units and said control unit, said data transmission system serving to transmit information of said identities of said valves, to said control unit.

11. An assembly according to claim 10, wherein said data-transmission system is a BUS or an CAN BUS.

12. An electro-hydraulic assembly particularly adapted for use with an underground self-advancing roof support as utilized in mining operations, said assembly comprising:

a valve body defining a plurality of recesses adapted for receiving and retaining hydraulic valves;

a plurality of hydraulic valves, each said valve disposed in a respective recess defined in said valve body;

a plurality of actuators, each said actuator in operable engagement with a respective valve of said plurality of valves;

a plurality of information elements, each said element disposed proximate to a respective valve and adapted to identify said valve;

a plurality of reader units, each said unit in communication with a respective information element and adapted to transmit information concerning the identity of said respective valve from said information element;

a hydraulic component;

a sensor in communication with said hydraulic component and adapted to measure a hydraulic state of said component;

another information element disposed proximate to said hydraulic component and adapted to identify said hydraulic component; and another reader unit adapted to transmit information concerning the identity of said hydraulic component from said other information element.

13. An electro-hydraulic assembly particularly adapted for use with an underground self-advancing roof support as utilized in mining operations, said assembly comprising:

a valve body defining a plurality of recesses adapted for receiving and retaining hydraulic valves;

a plurality of hydraulic valves, each said valve disposed in a respective recess defined in said valve body;

a plurality of actuators, each said actuator in operable engagement with a respective valve of said plurality of valves;

a plurality of information elements, each said element disposed proximate to a respective valve and adapted to identify said valve;

a plurality of reader units, each said unit in communication with a respective information element and adapted to transmit information concerning the identity of said respective valve from said information element; wherein said communication between said reader units and said information elements is inductive communication.

14. The assembly of claim 13 wherein each said reader unit is disposed on a corresponding actuator and sealed thereon.

15. The assembly of claim 13 wherein each said information element is disposed within a corresponding recess defined in said valve body and sealed therein.

* * * * *